US009702372B2

(12) United States Patent
Leininger et al.

(10) Patent No.: US 9,702,372 B2
(45) **Date of Patent: *Jul. 11, 2017**

(54) SYSTEM AND METHOD FOR CONTINUOUS SOLIDS SLURRY DEPRESSURIZATION

(71) Applicant: General Electric Company, Schenectady, NY (US)

(72) Inventors: Thomas Frederick Leininger, Chino Hills, CA (US); Raymond Douglas Steele, Cypress, TX (US); Stephen Michael Cordes, Cypress, TX (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 687 days.

This patent is subject to a terminal disclaimer.

(21) Appl. No.: 14/103,695

(22) Filed: Dec. 11, 2013

(65) Prior Publication Data

US 2015/0159654 A1 Jun. 11, 2015

(51) Int. Cl.
*F04D 29/22* (2006.01)
*F04D 15/00* (2006.01)

(52) U.S. Cl.
CPC ..... *F04D 29/2283* (2013.01); *F04D 15/0066* (2013.01)

(58) Field of Classification Search
CPC ..... F04D 29/2283; F04D 29/2288; F04D 15/0066; F04D 15/0005; F04D 1/003; Y10S 417/90
See application file for complete search history.

(56) References Cited

U.S. PATENT DOCUMENTS

| | | | |
|---|---|---|---|
| 1,459,923 | A | 6/1923 | Nagel |
| 1,813,575 | A | 7/1931 | Janecke et al. |
| 2,873,032 | A | 2/1959 | Henry |
| 3,035,306 | A | 5/1962 | Rossiter |
| 3,305,091 | A | 2/1967 | Brady |
| 3,602,552 | A | 8/1971 | Morgan |

(Continued)

FOREIGN PATENT DOCUMENTS

| | | | |
|---|---|---|---|
| CN | 86104452 | A | 4/1987 |
| CN | 101525118 | A | 9/2009 |

(Continued)

OTHER PUBLICATIONS

Perry, Robert H., Process Machinery Drives: Expansion Turbines, Perry's Chemical Engineers' Handbook, Sixth Edition, 1984, pp. 24-32 thru 24-37.

(Continued)

*Primary Examiner* — Craig Kim
*Assistant Examiner* — Juan G Flores
(74) *Attorney, Agent, or Firm* — Fletcher Yoder P.C.

(57) ABSTRACT

A system includes a first pump having a first outlet and a first inlet, and a controller. The first pump is configured to continuously receive a flow of a slurry into the first outlet at a first pressure and to continuously discharge the flow of the slurry from the first inlet at a second pressure less than the first pressure. The controller is configured to control a first speed of the first pump against the flow of the slurry based at least in part on the first pressure, wherein the first speed of the first pump is configured to resist a backflow of the slurry from the first outlet to the first inlet.

20 Claims, 5 Drawing Sheets

(56) References Cited

U.S. PATENT DOCUMENTS 3,841,465 A 10/1974 Miller et al.
3,865,727 A 2/1975 Broling et al.
3,875,051 A 4/1975 Kovarik
3,882,946 A 5/1975 Ioannesian et al.
3,944,380 A 3/1976 Kampe
3,992,784 A 11/1976 Verschuur et al.
4,017,270 A 4/1977 Funk et al.
4,106,533 A 8/1978 Herzig
4,126,519 A 11/1978 Murray
4,176,465 A 12/1979 Murray et al.
4,204,955 A 5/1980 Armstrong
4,236,868 A 12/1980 Linhardt
4,292,991 A 10/1981 Wing
4,313,737 A 2/1982 Massey et al.
4,322,389 A 3/1982 Schmid et al.
4,377,392 A 3/1983 Massey et al.
4,434,028 A 2/1984 Eppig et al.
4,472,171 A 9/1984 Broderick
4,477,257 A 10/1984 Koppelman et al.
4,516,674 A 5/1985 Firth et al.
4,666,464 A 5/1987 Najjar et al.
4,668,130 A 5/1987 Sharp
4,701,266 A 10/1987 Janka et al.
4,765,781 A 8/1988 Wilks et al.
4,801,210 A 1/1989 Gian
4,828,581 A 5/1989 Feldmann et al.
4,907,565 A 3/1990 Bailey et al.
4,967,673 A 11/1990 Gunn
5,050,375 A 9/1991 Dickinson
5,051,041 A 9/1991 Firth et al.
5,102,237 A 4/1992 Ide
5,188,741 A 2/1993 Zang et al.
5,223,144 A 6/1993 Woyciesjes et al.
5,223,199 A 6/1993 Ponzielli
5,269,635 A * 12/1993 Taylor, Jr. ..... B65G 53/66 37/309
5,355,993 A 10/1994 Hay et al.
5,356,280 A 10/1994 Ponzielli
5,381,886 A 1/1995 Hay et al.
5,402,876 A 4/1995 Hay et al.
5,443,162 A 8/1995 Sherman
5,459,674 A 10/1995 Ide et al.
5,485,909 A 1/1996 Hay et al.
5,495,674 A 3/1996 Taylor
5,497,872 A 3/1996 Pennino et al.
5,551,553 A 9/1996 Hay et al.
5,657,704 A 8/1997 Schueler
5,685,153 A 11/1997 Dickinson et al.
5,753,075 A 5/1998 Stromberg et al.
5,797,332 A 8/1998 Keller et al.
5,823,235 A 10/1998 Alley et al.
5,836,524 A 11/1998 Wang
5,853,488 A 12/1998 Silver
6,090,423 A 7/2000 Wetzel
6,141,796 A 11/2000 Cummings
6,213,033 B1 4/2001 Manelis et al.
6,213,289 B1 4/2001 Hay et al.
6,280,638 B1 8/2001 Belchev
6,375,841 B1 4/2002 Nemedi et al.
6,398,921 B1 6/2002 Moraski
6,640,696 B2 11/2003 Shinobudani et al.
6,706,199 B2 3/2004 Winter et al.
6,841,042 B2 * 1/2005 Stromberg ..... D21C 7/06 162/18
7,074,339 B1 7/2006 Mims
7,229,524 B2 6/2007 Snekkenes
7,374,734 B2 5/2008 Grossman et al.
7,493,969 B2 2/2009 Burnett et al.
7,562,777 B1 7/2009 Seenivasan
7,731,783 B2 6/2010 Sprouse et al.
7,745,568 B2 6/2010 Vandaele
8,434,641 B2 5/2013 Coughlin et al.
8,470,183 B2 6/2013 DeWaard
8,496,412 B2 7/2013 Livingood, III et al.
8,561,319 B2 10/2013 He
8,926,231 B2 1/2015 Liu et al.
8,926,846 B2 1/2015 DeWaard
8,951,314 B2 2/2015 Leininger et al.
8,992,641 B2 3/2015 Leininger et al.
9,156,631 B2 10/2015 Stevenson
9,181,046 B2 11/2015 Stevenson
2001/0026783 A1 10/2001 Winter et al.
2001/0032780 A1 10/2001 Winter et al.
2002/0110296 A1 8/2002 Smith et al.
2002/0130086 A1 9/2002 Miura
2004/0107700 A1 6/2004 McClanahan et al.
2005/0107648 A1 5/2005 Kimura et al.
2005/0177013 A1 8/2005 Countz
2006/0096163 A1 5/2006 Dickinson et al.
2006/0130357 A1 6/2006 Long, Jr.
2006/0165582 A1 7/2006 Brooker et al.
2006/0166810 A1 7/2006 Gunderman et al.
2008/0045762 A1 2/2008 Foody et al.
2008/0145156 A1 6/2008 Livingood et al.
2008/0251454 A1 10/2008 Waibel
2008/0287277 A1 11/2008 Pallmann
2009/0107046 A1 4/2009 Leinginger et al.
2009/0178338 A1 7/2009 Leininger et al.
2009/0217666 A1 9/2009 Farkaly
2010/0242354 A1 9/2010 Perkins et al.
2011/0068063 A1 3/2011 Mallonee et al.
2011/0072723 A1 3/2011 Liu et al.
2011/0091953 A1 4/2011 Bolin et al.
2011/0100359 A1 5/2011 North
2011/0139257 A1 6/2011 Bielenberg et al.
2011/0171114 A1 7/2011 Shaw
2011/0232191 A1 9/2011 Diebold et al.
2011/0251440 A1 10/2011 Huegle et al.
2012/0067047 A1 3/2012 Peterson et al.
2012/0067702 A1 3/2012 Frey et al.
2012/0171054 A1 7/2012 Russell
2012/0198768 A1 8/2012 Khosravian et al.
2012/0205222 A1 8/2012 Russell et al.
2012/0234652 A1 9/2012 Stevenson et al.
2012/0255706 A1 10/2012 Tadayon et al.
2012/0282467 A1 11/2012 Iyer et al.
2013/0019530 A1 1/2013 Favilli et al.
2013/0098765 A1 4/2013 Stradi
2013/0126002 A1 5/2013 Bathurst
2013/0255143 A1 10/2013 Frey et al.
2013/0259671 A1 10/2013 Leininger
2013/0269735 A1 10/2013 Roetzel
2013/0276822 A1 10/2013 Plavidal
2013/0295628 A1 11/2013 Retsina et al.
2013/0327028 A1 12/2013 Steele et al.
2014/0027246 A1 1/2014 Stevenson et al.
2014/0110320 A1 4/2014 Thomas
2014/0123973 A1 5/2014 North
2014/0150288 A1 6/2014 Leininger et al.
2014/0150873 A1 6/2014 Stevenson et al.
2014/0151191 A1 6/2014 Stevenson et al.
2015/0090938 A1 4/2015 Meyer et al.

FOREIGN PATENT DOCUMENTS

CN 101952658 A 1/2011
EP 0256186 A1 2/1988
EP 0343620 A2 11/1989
EP 0418442 A1 3/1991
EP 0646746 A2 4/1995
EP 1500863 A2 1/2005
EP 1256375 B1 1/2011
EP 2386621 A2 11/2011
FR 2811380 A1 1/2002
FR 2811380 B1 10/2002
GB 191024001 A 7/1911
GB 1457839 12/1976
PL 404251 A 12/2013
RU 2376493 C2 12/2009
RU 2421612 C1 6/2011
WO WO 96/24810 8/1996
WO 9825027 A1 6/1998
WO 9943954 A1 9/1999
WO 0053924 A1 9/2000

(56) References Cited

FOREIGN PATENT DOCUMENTS

| | | | |
|---|---|---|---|
| WO | 0202935 | A1 | 1/2002 |
| WO | 03067082 | A1 | 8/2003 |
| WO | WO 2011/121423 | A2 | 10/2011 |
| WO | WO 2011/139164 | A1 | 11/2011 |
| WO | WO 2012/040110 | A2 | 3/2012 |
| WO | WO 2013/087521 | A2 | 6/2013 |

OTHER PUBLICATIONS

Perry, Robert H., Process Machinery Drives Expansion Turbines, Perry's Chemical Engineers' Handbook, Sixth Edition, 1984, pp. 24-32 thru 24-37.

U.S. Appl. No. 14/103,714, filed Dec. 11, 2013, Hsien-Chin William Yen.

U.S. Appl. No. 61/914,919, filed Dec. 11, 2013, Thomas Frederick Leininger.

U.S. Appl. No. 13/491,463, filed Jun. 7, 2012, Raymond Douglas Steele.

Stamet Inc., Continuous Mechanically Controlled Solids Ash Metering from High to Low Gas Pressure, SBIR/STTR, http://www.sbir.gov/sbirsearch/detail/316954, 1997; 2 pages.

* cited by examiner

SYSTEM AND METHOD FOR CONTINUOUS SOLIDS SLURRY DEPRESSURIZATION

STATEMENT REGARDING FEDERALLY SPONSORED RESEARCH & DEVELOPMENT

This invention was made with Government support under contract number DE-FE0007859 awarded by the Department of Energy. The Government has certain rights in the invention.

BACKGROUND

The subject matter disclosed herein relates to a slag handling system, and, more particularly, to a continuous slag handling system.

An industrial process may utilize a slurry, or fluid mixture of solid particles suspended in a liquid (e.g., water), to convey the solid particles through the respective process. For example, partial oxidation systems may partially oxidize carbon-containing compounds in an oxygen-containing environment to generate various products and by-products. For example, gasifiers may convert carbonaceous materials into a useful mixture of carbon monoxide and hydrogen, referred to as synthesis gas or syngas. In the case of an ash-containing carbonaceous material, the resulting syngas may also include less desirable components, such as molten ash, also known as molten slag, which may be removed from the gasifier along with the useful syngas produced. Accordingly, the molten slag byproduct produced in the gasifier reactions may be directed into a gasifier quench liquid in order to solidify the molten slag and to create a slurry. Generally, this slurry is discharged from the gasifier at elevated temperatures and high pressures. The slurry discharged from the gasifier is depressurized to enable the disposal of, or the further processing of, the slurry.

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a first pump having a first outlet and a first inlet, and a controller. The first pump is configured to continuously receive a flow of a slurry into the first outlet at a first pressure and to continuously discharge the flow of the slurry from the first inlet at a second pressure less than the first pressure. The controller is configured to control a first speed of the first pump against the flow of the slurry based at least in part on the first pressure, wherein the first speed of the first pump is configured to resist a backflow of the slurry from the first outlet to the first inlet.

In a second embodiment, a system includes a reverse-acting pump having an outlet and an inlet, an isolation valve coupled to the outlet of the reverse-acting pump, and a controller coupled to the reverse-acting pump and the isolation valve. The outlet is configured to continuously receive a flow of slurry at a first pressure and the inlet is configured to continuously discharge the flow of the slurry at a second pressure less than the first pressure. The controller is configured to control the flow of the slurry through the reverse-acting pump via control of a speed of the reverse-acting pump, to close the isolation valve, or any combination thereof.

In a third embodiment, a method includes receiving a flow of a slurry at a first pressure through an outlet of a pump, driving the pump at a speed configured to resist a backflow of the slurry from the outlet to an inlet, controlling the speed of the pump, discharging the flow of the slurry at a second pressure less than the first pressure from the inlet of the pump, and controlling a rate of the flow of the slurry through the pump via controlling the speed of the pump.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
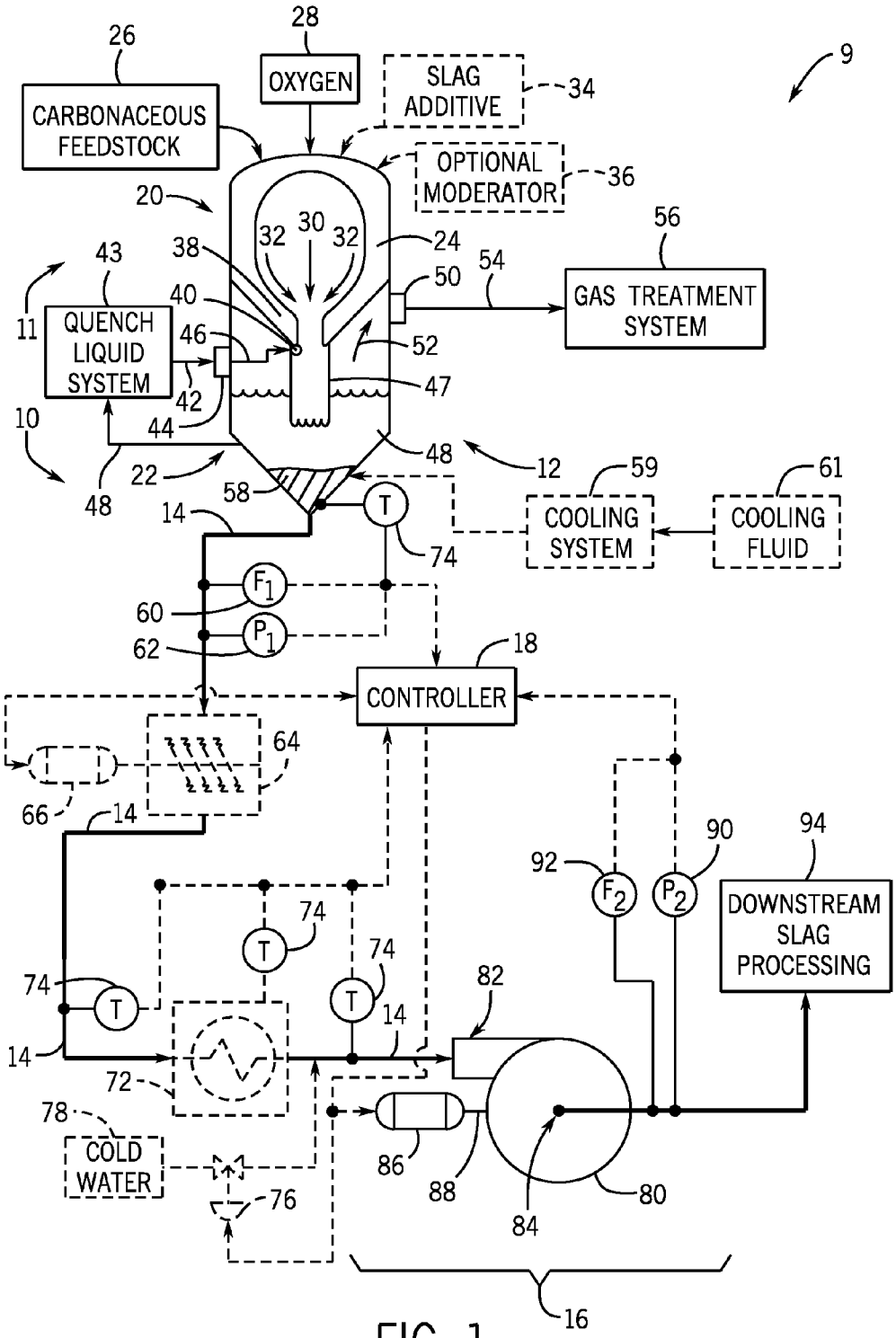
FIG. 1 is a schematic diagram of an embodiment of a continuous slag removal system with a depressurization system.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

Various industrial processes involve the handling of slurries. A slurry may include particulate solids dispersed in a fluid, such as water. In certain situations, the slurry is transported from a first location (e.g., vessel) to a second location. The slurry may be depressurized and/or cooled during transport from the first location to the second location. For example, the reaction chamber of a partial oxidation system (e.g., a gasifier) may receive a carbonaceous feedstock (e.g., a slurry of carbonaceous particulate solids such as coal or biomass, a pneumatically-conveyed stream of particulate solids, a liquid, a gas, or any combination thereof) and an oxidant, (e.g., high purity oxygen). In some embodiments, the reaction chamber may receive water (e.g., water spray or steam) to contribute to the slurry. The partial oxidation of the feedstock, the oxidant, and in some cases, water, may produce a useful gaseous product and an ash or a molten slag byproduct. For example, a gasifier may receive the feedstock, the oxygen, and the water to generate a synthetic gas, or syngas, and a molten slag. In certain cases, the molten slag may flow through the gasifier into a quench liquid, such as water, to create a slag slurry. The slag slurry discharged from the gasifier may be at a pressure between approximately 100 to 10,000 kilopascals (kPa) (e.g., approximately 14.5 pounds per square inch (psi) to 1,450 psi). Before the slag slurry is further processed or disposed of, the slag slurry may be depressurized to a lower pressure, such as an atmospheric pressure. Depressurization of the slag slurry at elevated temperatures may cause vapor flash where at least a portion of the liquid (e.g., water) in the slag slurry evaporates. Accordingly, the slag slurry may be cooled prior to exiting the gasifier (e.g., via a cooling system coupled to a downstream end portion of the gasifier), or between the gasifier and a depressurization system (e.g., via a heat exchanger and/or injected cool water).

The disclosed embodiments move the slurry in a continuous process, rather than a batch process. Although a lock hopper system can effectively remove the slurry, it operates cyclically in a batch mode, occupies a large amount of vertical space, and may include expensive valves. Valves of a lock hopper system may be limited in size and may not scale-up well to very large systems. Furthermore, the lock hopper system may use additional amounts of water, which may be removed during supplementary slurry processing. Thus, the disclosed embodiments include a depressurization system employing a reverse-acting pump to continuously reduce the pressure of a slag slurry and transport the slag slurry from a high pressure zone to a low pressure zone. As may be appreciated, the disclosed embodiments may consume less space than a batch process and may be implemented with smaller equipment than a batch process.

For example, the disclosed embodiments include a depressurization system that uses a reverse-acting pump to continuously reduce the pressure of the slurry. The reverse-acting pump drives at least a portion of the slurry against the net flow of the slurry through the reverse-acting pump from the outlet to the inlet. The reverse-acting pump utilizes rotating discs to drive at least a portion of the slurry near the surface of the rotating discs from the inlet to the outlet at a discharge pressure. The portion of the slurry driven to the outlet may recirculate back to the inlet with additional slurry from a high pressure system coupled to the outlet. The recirculated portion of the slurry and the additional slurry flow from the outlet to the inlet along a middle region between the rotating discs. The recirculated portion of the slurry and the additional slurry from the high pressure system coupled to the outlet may flow downstream through the inlet at a downstream pressure that is less than the pressure of the high pressure system. In other words, the reverse-acting pump drives the portion of the slurry from the inlet to the outlet to resist the net flow of the slurry from the outlet to the inlet. The resistance of the reverse-acting pump decreases the pressure of the slurry from the outlet to the inlet from the pressure of the high pressure system to the downstream pressure.

In certain embodiments, the depressurization system is used for continuous slag removal from partial oxidation systems or other pressurized slurry systems to reduce the initial pressure (e.g., upstream pressure) of the slurry to a lower pressure, such as an atmospheric pressure or a pressure that is sufficient to drive the depressurized slag slurry through the remainder of the slag slurry removal system (e.g., downstream slag processing system).

With the foregoing in mind, FIG. 1 is a schematic diagram of an embodiment of a system 9 having a gasification system 11 and a continuous slag removal system 10. As shown in FIG. 1, the continuous slag removal system 10 may include a slag slurry 14, a depressurization system 16 (e.g., one or more reverse-acting pumps), and a controller 18.

The gasification system 11 may include a partial oxidation system, such as a gasifier 12, which may further include a reaction chamber 20 and a quench chamber 22. A protective barrier 24 may enclose the reaction chamber 20, and may act as a physical barrier, a thermal barrier, a chemical barrier, or any combination thereof. Examples of materials that may be used for the protective barrier 24 include, but are not limited to, refractory materials, non-metallic materials, ceramics, and oxides of chromium, aluminum, silicon, magnesium, iron, titanium, zirconium, and calcium. In addition, the materials used for the protective barrier 24 may be in the form of bricks, castable refractory material, coatings, a metal wall, or any combination thereof. In general, the reaction chamber 20 may provide a controlled environment for the partial oxidation chemical reactions to take place. Partial oxidation chemical reactions can occur when a fuel or a hydrocarbon is mixed with sub-stoichiometric amounts of oxygen in a high temperature reactor to produce a gaseous product and byproducts. For example, a carbonaceous feedstock 26 may be introduced to the reaction chamber 20 with oxygen 28 to produce an untreated syngas 30 and a molten slag 32. The carbonaceous feedstock 26 may include materials such as biofuels or fossil fuels, and may be in the form of a solid, a liquid, a gas, a slurry, or any combination thereof. The oxygen 28 introduced to the reaction chamber 20 may be replaced with air or oxygen-enriched air. In certain embodiments, an optional slag additive 34 may also be added to the reaction chamber 20. The slag additive 34 may be used to modify the viscosity of the molten slag 32 inside the reaction chamber 20 to improve slag flow characteristics and to ensure reliable movement of molten slag from the reaction chamber 20 into the quench chamber 22. In yet other embodiments, an optional moderator 36, such as water or steam, may also be introduced into the reaction chamber 20. The chemical reactions within the reaction chamber 20 may be accomplished by subjecting the carbonaceous feedstock 26 to steam and oxygen at elevated pressures (e.g., from approximately 2,000 to 10,000 kPa, or 3,000 to 8,500 kPa; from approximately 290 to 1,450 psi, or 435 to 1,233 psi) and temperatures (e.g., approximately 1,100 degrees C. to 1,500 degrees C., or 1,200 degrees C. to 1,450 degrees C.; from approximately 2,012 degrees F. to 2,732 degrees F., or 2,192 degrees F. to 2,642 degrees F.), depending on the type of gasifier 12 utilized. Under these conditions, and depending upon the composition of the ash in the carbonaceous feedstock 26, the ash may be in the molten state, which is referred to as molten ash, or molten slag 32.

The quench chamber 22 of the gasifier 12 may receive the untreated syngas 30 and the molten slag 32 as it leaves the reaction chamber 20 through the bottom end 38 (or throat) of the protective barrier 24. The untreated syngas 30 and the molten slag 32 enter the quench chamber 22 at a high pressure (e.g., upstream pressure) and a high temperature. In general, the quench chamber 22 may be used to reduce the temperature of the untreated syngas 30, to disengage the molten slag 32 from the untreated syngas 30, and to quench the molten slag 32. In certain embodiments, a quench ring 40, located at the bottom end 38 of the protective barrier 24, is configured to provide a quench liquid 42 (e.g., water) from a quench liquid system 43 to the quench chamber 22. The quench liquid may be received by a quench inlet 44 and into the quench ring 40 through a line 46. In general, the quench liquid 42 may flow through the quench ring 40 and down the inner surface of a dip tube 47 into a quench chamber sump 48. Quench liquid 42 may return via quench liquid blowdown line 49 to the quench liquid system 43 for cooling and cleaning prior to returning to the quench ring 40. Likewise, the untreated syngas 30 and the molten slag 32 may also flow through the bottom end 38 of the protective barrier 24, and through the dip tube 47 into the quench chamber sump 48. As the untreated syngas 30 passes through the pool of quench liquid 42 in the quench chamber sump 48, the molten slag 32 is solidified and disengaged from the syngas, the syngas is cooled and quenched, and the syngas subsequently exits the quench chamber 22 through a syngas outlet 50, as illustrated by arrow 52. Quenched syngas 54 exits through the syngas outlet 50 for further processing in a gas treatment system 56, where it may be further processed to remove acid gases, particulates, etc., to form a treated syngas. Solidified slag 58 may accumulate at the bottom of the quench chamber sump 48 and may be continuously removed from the gasifier 12 as a slag slurry 14. In certain embodiments, a portion of the quench liquid 42 may also be continuously removed via quench liquid blowdown line 49 from the quench chamber sump 48 for treatment in quench liquid system 43. For example, fine particulates, soot, fine slag, and other matter may be removed from the quench liquid 42 in the quench liquid system 43, and the treated quench liquid 42 may be returned to the quench chamber sump 48 through the quench inlet 44.

The slag slurry 14 may have various compositions of solids suspended in the quench liquid 42, including, but not limited to, char (i.e. partially reacted fuel), solidified ash particles of various sizes, and/or portions of the reaction chamber protective barrier 24. The slag slurry 14 being discharged from the gasifier 12 may have a high pressure (e.g., upstream pressure) and a high temperature. For example, the pressure of the slag slurry 14 may be between approximately 100 to 10,000 kPa (e.g., 14.5 to 1,450 psi), 2,000 to 9,000 kPa (e.g., 290 to 1,305 psi), or 3,000 to 8,000 kPa (e.g., 435 to 1,160 psi), and the temperature of the slag slurry may be between approximately 150 to 350 degrees C. (e.g., 300 to 660 degrees F.), 200 to 300 degrees C. (e.g., 390 to 570 degrees F.), or 225 to 275 degrees C. (e.g., 435 to 525 degrees F.). In some embodiments, a cooling system 59 coupled to or integrally formed with the gasifier 12 may cool the slag 58 and slag slurry 14 before the slag slurry 14 exits the gasifier 12. The cooling system 59 may dispense (e.g., inject) a cooling fluid 61 (e.g., water) into the slag slurry 14 at a downstream end portion of the gasifier 12 to reduce the temperature of the slag slurry 14. Additionally, or in the alternative, a heat exchanger 72 (e.g., cooler) may reduce the temperature of the slag slurry 14 before the slag slurry 14 is fed through the depressurization system 16 to reduce or prevent flashing (i.e., vaporization) of the slag slurry 14 as it moves through the depressurization system 16. The heat exchanger 72 may allow for cooling of the slag slurry 14 without using additional quench liquid 42, such as water, which may involve additional processing (e.g., dewatering) of the slag slurry 14 to remove. In some embodiments, cooling the slag slurry 14 without the use of additional water may simplify downstream processing of the slag slurry 14, e.g., by reducing the amount of water to be removed before disposal of the slag slurry 14. Furthermore, as the slag slurry 14 moves through the heat exchanger 72, the pressure of the slag slurry 14 may drop, simplifying final processing and/or disposal of the slag slurry 14.

In certain embodiments, the controller 18 may receive signals from various sensors disposed throughout the continuous slag removal system 10. For example, sensors may provide information regarding characteristics of the slag slurry 14, operating conditions within the continuous slag removal system 10, the flow rate of the slag slurry 14, temperatures of the slag slurry 14 at various sites, pressures of the slag slurry 14 at various sites, and so forth. For example, a flow sensor "F1" 60 may provide information regarding the flow rate of the slag slurry 14 exiting from the gasifier 12. A first pressure sensor "P1" 62 may provide information on the first pressure (e.g., upstream pressure) of the slag slurry 14 exiting from the gasifier 12. The first pressure may be approximately equal to the pressure of the gasifier 12. In some embodiments, the controller 18 may receive additional sensor information about the slag slurry 14 as it exits the gasifier 12, such as, but not limited to, viscosity, temperature, particle size, and so forth. Furthermore, the controller 18 may adjust operational conditions of the continuous slag removal system 10 in response to received sensor information, as described in detail below.

In some embodiments, one or more slag crushers 64 coupled to a slag crusher driver 66 (e.g., a hydraulic motor, an electric motor, or other source of power) may optionally receive the slag slurry 14 before it is fed through the depressurization system 16. The slag crusher 64 may crush particles within the slag slurry 14 to attain a desired maximum particle size (e.g., top size) of particles in the slag slurry 14. The slag crusher 64 may reduce the size of particles (e.g., relatively large chunks of solidified slag 58 and/or portions of the reaction chamber protective barrier 24) greater than the top size. The slag crusher 64 may include one or more stages. Establishing an appropriate top size may be useful for enabling the slag slurry 14 to flow without obstructing certain passages, and for the operation of the depressurization system 16. In certain embodiments, the slag crusher 64 may reduce the particle size such that the top particle size is less than approximately 25 mm (1.0 inch), 19 mm (0.75 inch), or 13 mm (0.5 inch). In certain embodiments, a single slag crusher 64 may be sufficient to establish this top size, and in other embodiments, two or more slag crushers 64 may function together (e.g., in series) to establish this top particle size. For example, a first slag crusher may provide a coarse crushing of the slag slurry 14 while a second slag crusher may provide a finer crushing of the slag slurry 14. In one embodiment, the controller 18 may control the slag crusher 64 by controlling the slag crusher motor 66. The controller 18 may adjust the slag crusher motor 66 based on information received from the sensors.

In some embodiments, the controller 18 may receive information about the temperature of the slag slurry 14 from the temperature sensors "T" 74, which are located at various sites of the slag removal system 10. For example, the temperature sensors "T" 74 may be located before the slag slurry 14 exits the gasifier 12, before the slag slurry 14 enters the heat exchanger 72, coupled to the heat exchanger 72, or located after the slag slurry 14 leaves the heat exchanger 72. In response to the information received by the temperature sensors "T" 74, the controller 18 may control the cooling provided by the cooling system 59 and/or by the heat exchanger 72. For example, the controller 18 may adjust a control valve that controls the flow rate of the cooling fluid 61 to the cooling system 59 and/or the flow rate of a coolant through the heat exchanger 72. In some embodiments, in response to the information received by the temperature sensors "T" 74, the controller 18 may adjust a flow control valve 76 to add cold water 78 directly to the slag slurry 14. The cold water 78 may further cool the slag slurry 14 before the slag slurry 14 is fed into the depressurization system 16. The cold water 78 may be removed in the additional processing of the slag slurry 14 by a downstream slag processing system 94. The addition of the cold water 78 may be omitted. In certain embodiments, the temperature of the slag slurry 14 downstream of the heat exchanger 72 or the addition of the cold water 78 may be between approximately 10 to 150 degrees C. (e.g., approximately 10 to 302 degrees F.), 20 to 125 degrees C. (e.g., 68 to 257 degrees F.), or 30 to 100 degrees C. (e.g., 86 to 212 degrees F.).

In certain embodiments, the slag slurry 14 may be fed into the depressurization system 16. The depressurization system 16 has at least one reverse-acting pump 80 that receives the slag slurry 14 through an outlet 82, and discharges the slag slurry 14 through an inlet 84. Conventionally, a pump receives a fluid at the inlet at a relatively low pressure, and discharges the fluid from the outlet at a relatively high pressure. In other words, the reverse-acting pump 80 is configured to convey the slag slurry 14 in an opposite direction through the pump relative to a conventional pump. A motor 86 drives the reverse-acting pump 80 via a shaft 88. As discussed in detail below, the reverse-acting pump 80 is driven against the flow of the slag slurry 14 from the gasifier 12. The motor 86 drives the reverse-acting pump 80 to move at least a portion of the slag slurry 14 at an inlet pressure (e.g., atmospheric pressure) from the inlet 84 to the outlet 82 at a discharge pressure. The portion of the slag slurry 14 driven to the outlet at the discharge pressure may not flow upstream beyond the outlet 82, but rather recirculates to the inlet 84 when the upstream pressure (e.g., pressure at "P1" 62) at the outlet 82 is greater than or equal to the discharge pressure generated by the pump at the speed at which it is rotating. The discharge pressure and the difference between the inlet pressure and the discharge pressure may be based at least in part on a speed of the reverse-acting pump 80. When the upstream pressure of the slag slurry 14 from the gasifier 12 (e.g., as sensed by pressure sensor "P1" 62) is greater than the discharge pressure generated by the pump at the speed at which it is rotating, the reverse-acting pump 80 enables the slag slurry 14 to continuously flow from the outlet 82 to the inlet 84 while depressurizing the slag slurry 14 as discussed below. That is, the upstream pressure of the slag slurry 14 decreases from the upstream pressure sensed by the pressure sensor "P1" 62 to the inlet pressure at the inlet 84 while flowing through the reverse-acting pump 80.

In some embodiments, a pressure sensor "P2" 90 may sense a downstream pressure of the slag slurry 14 downstream of the at least one reverse-acting pump 80. The pressure drop of the slag slurry 14 across the reverse-acting pump 80 may be between approximately 100 to 10,000 kPa, 2,000 to 9,000 kPa, or 3,000 to 8,000 kPa (e.g., approximately 14.5 to 1,450 psi, 290 to 1,305 psi, or 435 to 1,160 psi). The downstream pressure of the slag slurry 14, as indicated by the second pressure sensor "P2" 90, may be between approximately atmospheric pressure (0 kPa) to 690 kPa, 69 to 520 kPa, or 138 to 345 kPa (e.g., approximately 0 to 100 psi, 10 to 75 psi, or 20 to 50 psi), all expressed in gauge pressure. In certain embodiments, the second (e.g., downstream) pressure at the inlet 84 is approximately equal to atmospheric pressure. Additionally, or in the alternative, a flow sensor "F2" 92 may sense the flow rate of the slag slurry 14 between the reverse-acting pump 80 and the downstream slag processing system 94. The downstream slag processing system 94 may dewater the slag slurry 14 and/or dispose of the slag slurry 14.

The controller 18 may control the flow of the slag slurry 14 through the reverse-acting pump 80 via control of the motor 86. The reverse-acting pump 80 is a variable-speed pump, thereby enabling the motor 86 to control the speed of the reverse-acting pump 80. Through controlling the speed of the reverse-acting pump 80, the controller 18 may control the discharge pressure at the outlet 82, thereby controlling the rate at which slag slurry 14 flows through the reverse-acting pump 80 from higher pressure outlet 82 to lower pressure inlet 84.

As discussed herein, the terms upstream and downstream refer to directions relative to the flow of a fluid (e.g., slag slurry 14) through the continuous slag removal system 10. Generally, the arrows of FIG. 1 illustrating the slag slurry 14 flow extend in the downstream direction from the gasifier 12 to the downstream slag processing system 94. Accordingly, the gasifier 12 is arranged upstream of the one or more slag crushers 64 and the depressurization system 16. The upstream pressure at the outlet 82 is the pressure of a fluid (e.g., slag slurry 14) immediately upstream of the reverse-acting pump 80, and the downstream pressure at the inlet 84 is the pressure of the fluid (e.g., slag slurry 14) immediately downstream of the reverse-acting pump 80. That is, the slag slurry 14 flows through the reverse-acting pump 80 from the outlet 82 at the relatively high upstream pressure to the inlet 84 at the relatively low downstream pressure. Accordingly, the slag slurry 14 backflows (e.g., from high pressure outlet to low pressure inlet) through the reverse-acting pump relative to the conventional direction (e.g., from low pressure inlet to high pressure outlet) of flow through a pump. Thus, as discussed herein, the terms upstream pressure and downstream pressure are relative to the installation orientation of the reverse-acting pump 80 such that the outlet 82 receives the fluid (e.g., slag slurry 14) at the upstream pressure and the inlet 84 discharges the fluid (e.g., slag slurry 14) at the downstream pressure as the fluid (e.g., slag slurry 14) flows downstream (i.e. backflows) through the reverse-acting pump 80 from a high pressure system (e.g., gasifier 12) to a low pressure system (e.g., downstream slag processing system 94).

Figure 2:
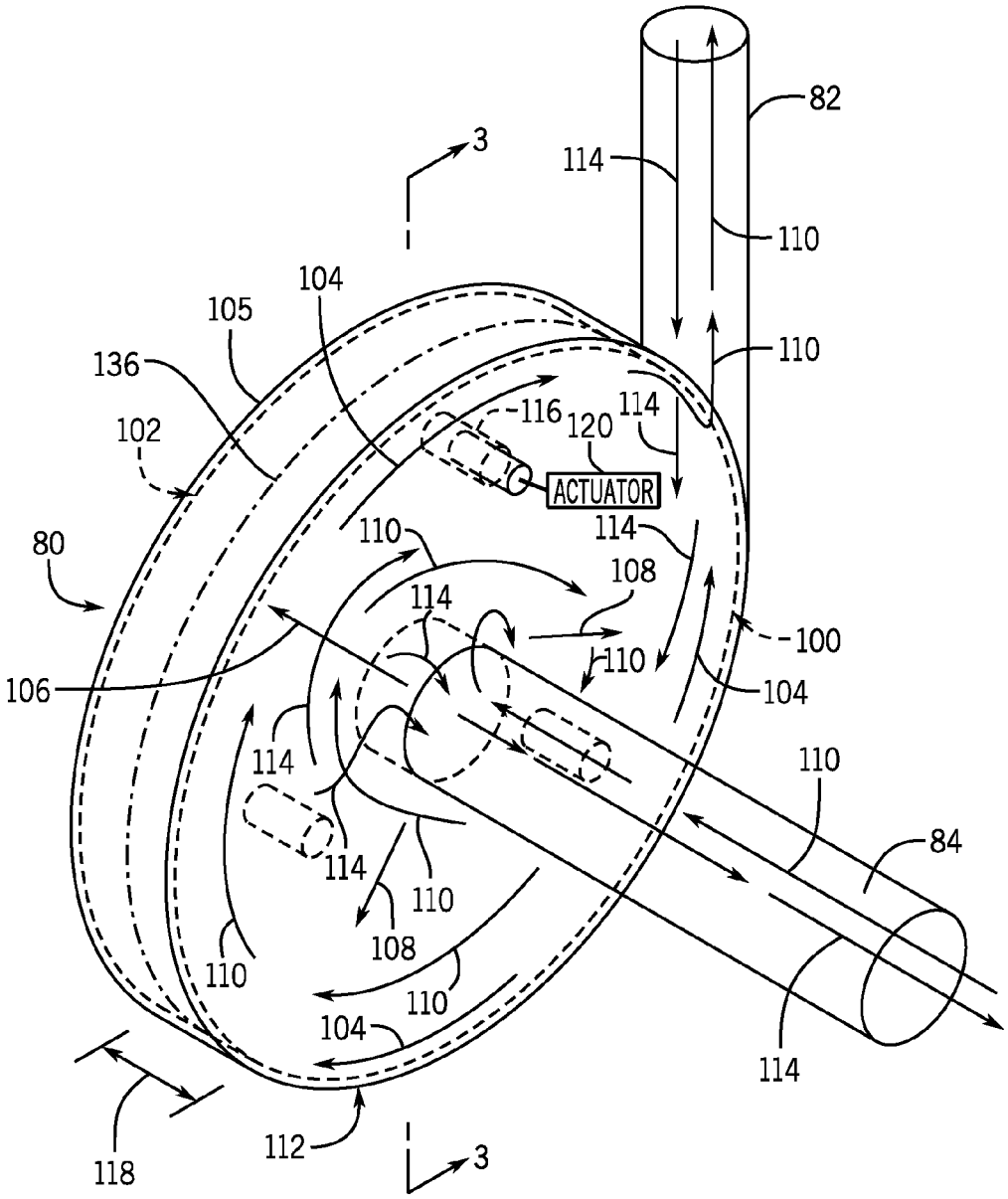
FIG. 2 is a perspective view of an embodiment of a reverse-acting pump of the depressurization system of FIG. 1.

FIG. 2 illustrates a perspective view of an embodiment of the reverse-acting pump 80 of FIG. 1. Opposing discs 100, 102 of the reverse-acting pump 80 rotate in a tangential direction 104 within a housing 105, drawing at least a portion of a fluid (e.g., slag slurry 14) from the inlet 84 to the outlet 82. As illustrated in FIG. 2, polar coordinates are utilized to describe relative directions of the reverse-acting pump 80 relative to an axis 106 of the inlet 82. For example, the inlet 84 is substantially parallel (e.g., aligned) with the longitudinal axis 106 relative to the reverse-acting pump 80. The outlet 82 may be tangentially aligned substantially opposite to the clockwise tangential direction 104 at a perimeter 112 of the housing 105. The opposing discs 100, 102 rotate in the clockwise tangential direction 104 about the longitudinal axis 106, driving the fluid (e.g., slag slurry 14) in both the radial outward direction 108 and the tangential clockwise direction 104. As may be appreciated, frictional forces from the opposing discs 100, 102 impart both a rotational clockwise (e.g., along arrows 104) and a radial outwards (e.g., along arrows 108) motion on fluid layers adjacent to the discs 100, 102. The viscous forces within the fluid transmit the rotational clockwise and radial outwards motion to adjacent layers of fluid that lie progressively further away from the discs 100, 102 and progressively closer to a centerline 136 between the two discs 100, 102.

When the rotational speed of the discs 100, 102 is relatively high and/or the upstream pressure of the system (e.g., gasifier 12) connected to the outlet 82 is less than the discharge pressure of the reverse-acting pump 80 at the rotational speed, then the reverse-acting pump 80 may drive the fluid through the reverse-acting pump 80 as shown by the arrows 110. The arrows 110 show the direction of fluid flow if the reverse-acting pump 80 is installed and operated as a conventional pump to drive the fluid flow from the inlet 84 to the outlet 82. When the rotational speed of the discs 100, 102 is relatively low and/or the upstream pressure at the outlet 82 of the reverse-acting pump 80 is greater than the discharge pressure of the reverse-acting pump 80 at the rotational speed, then the fluid will backflow through the reverse-acting pump 80 in a direction 114 that is opposite from the conventional direction 110 (e.g., from the outlet 82 to the inlet 84. As discussed in detail below, when the upstream pressure at the outlet 82 of the reverse-acting pump 80 is approximately equal to the discharge pressure, the fluid recirculates within the reverse-acting pump 80. When the upstream pressure at the outlet 82 of the reverse-acting pump 80 is greater than the discharge pressure, then the net flow of fluid through the reverse-acting pump 80 flows from the outlet 82 to the inlet 84. At least a portion of the fluid recirculates within the reverse-acting pump 80 and the remainder of the fluid backflows through the reverse-acting pump 80, as shown by arrows 114 from the outlet 82 to the inlet 84.

The opposing discs 100, 102 rotate about the longitudinal axis 106 at approximately the same rate. The rotational speed of the opposing discs 100, 102 affects the discharge pressure at the outlet 82. In some embodiments, the discharge pressure may be greater than approximately 250, 500, 1000, 2000, 3000, or 4000 kPa or more. The reverse-acting pump 80 may include, but is not limited to, a disc pump from Discflo Corporation of Santee, Calif. One or more spacers 116 separate the opposing discs 100, 102 by a distance 118. The one or more spacers 116 are not configured to significantly affect the fluid (e.g., slurry), such as by driving or impelling the fluid through the disc pump 80. That is, the fluid (e.g., slurry) may substantially flow around the one or more spacers 116. In some embodiments, the spacers 116 may be adjusted along the longitudinal axis 106 by one or more actuators 120 to control the distance 118. For example, the one or more spacers 116 may be telescoping spacers. The one or more actuators 120 may be coupled to the discs 100, 102 and/or directly to the one or more spacers 116. The one or more actuators 120 may include, but are not limited to, hydraulic actuators, pneumatic actuators, electric motors, or any combination thereof. Decreasing the distance 118 while maintaining the rotational speed of the opposing discs 100, 102 may increase the discharge pressure, whereas increasing the distance 118 while maintaining the rotational speed may decrease the discharge pressure.

Figure 3:
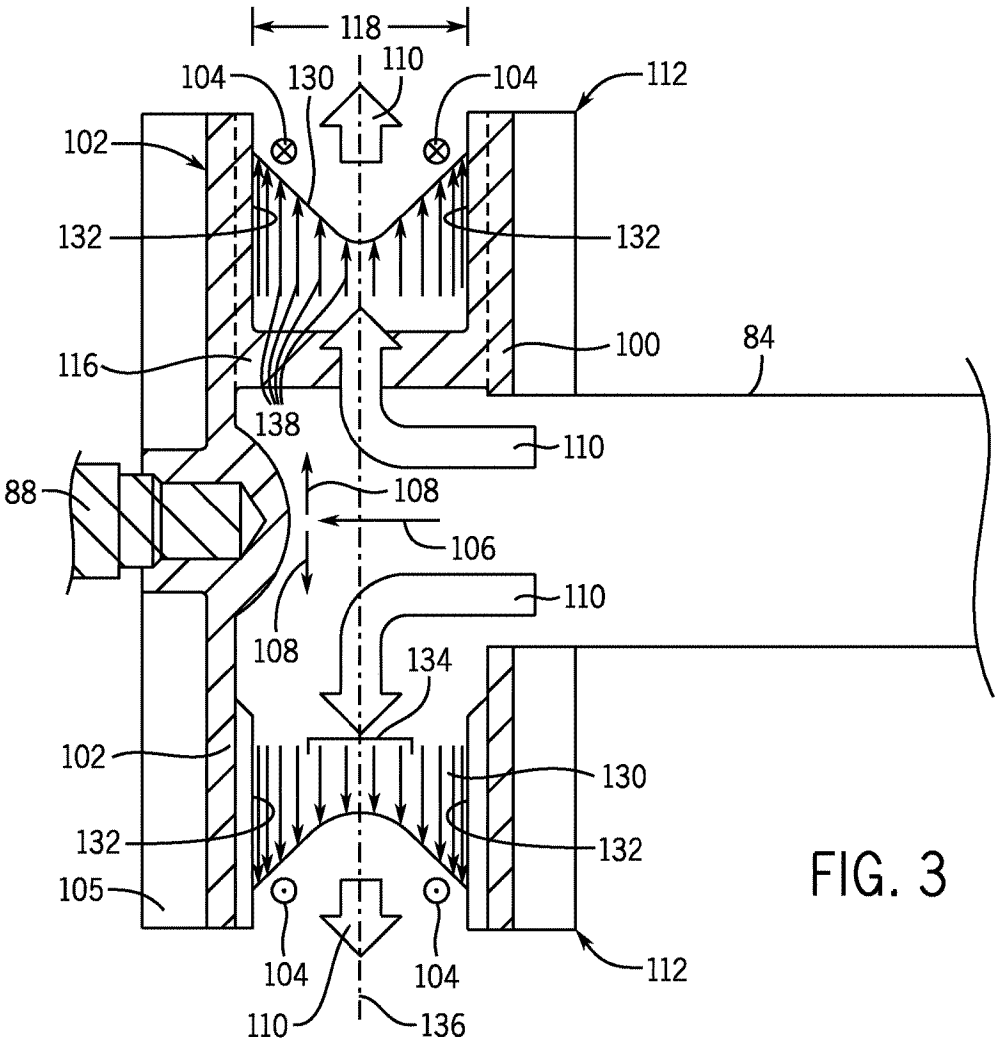
FIG. 3 is a cross-sectional view of an embodiment of the reverse-acting pump of FIG. 2, taken along line 3-3.

FIG. 3 illustrates a cross-sectional view of an embodiment of the reverse-acting pump 80 of FIG. 2, taken along line 3-3. The illustrated cross-sectional view in FIG. 3 depicts an embodiment of the reverse-acting pump 80 in operation when the discharge pressure generated by the rotation of the discs 100, 102 is greater than the upstream pressure at the outlet 82. At least one of the opposing discs (e.g., disc 102) is directly coupled to the shaft 88, which drives the disc 102 in the tangential direction 104. The rotational motion of the shaft 88 and the directly coupled disc 102 is transmitted to the opposing disc 100 by two or more spacers 116, only one of which is shown in FIG. 3. The rotating discs 100, 102 exert forces on the fluid within the reverse-acting pump 80. The radial velocity profile 130 of the fluid within the reverse-acting pump 80 illustrated in FIG. 3 is based on the existence of a no-slip condition between the fluid (e.g., slag slurry) and the disc surfaces 132 when the discharge pressure generated by the rotation of the discs 100, 102 is greater than the upstream pressure at the outlet 82. The no-slip condition means that fluid interfacing with the disc surfaces 132 adheres to and/or does not move (e.g., no velocity) relative to the disc surface 132, whereas the fluid in a middle region 134 between the disc surfaces 132 may move with lower velocity that decreases towards a centerline 136 between the two discs 100, 102 of the reverse-acting pump 80. Viscous drag transfers momentum (i.e., velocity) from one fluid layer to another fluid layer between the discs 100, 102. However, viscous drag inefficiencies cause the fluid layers near the centerline 136 (e.g., middle region 134) to have a lower velocity than the fluid layers adjacent the surfaces 132 of the discs 100, 102. When the discharge pressure generated by the rotation of the discs 100, 102 is greater than the upstream pressure at the outlet 82, the fluid flows radially outward, as shown by arrows 110, from the inlet 84 towards the outlet 82 at the perimeter 112. Accordingly, each of the vectors 138 of the radial velocity profile 130 also extends outward towards the perimeter 112, indicating the net flow of the fluid.

While FIG. 3 illustrates flows along the longitudinal axis 106 and the radial axis 108, it may be appreciated that the fluid (e.g., slag slurry 14) also rotates about the longitudinal axis 108 in the clockwise tangential direction 104 as the discs 100, 102 rotate about the shaft 88. In some embodiments, the controller 18 may be configured to reduce operation of the reverse-acting pump 80 to direct any fluid upstream (e.g., flow in the normal direction of a conventional pump), as shown by arrows 110. In some embodiments, the controller 18 may control the reverse-acting pump 80 or motor 86 to reduce such a net fluid flow from the inlet 84 to the outlet 82. For example, the controller 18 may slow the speed of the reverse-acting pump 80 to reduce the upstream flow of the fluid from the inlet 84 to the outlet 82, such as a flow of slag slurry 14 into the gasifier 12.

Figure 4:
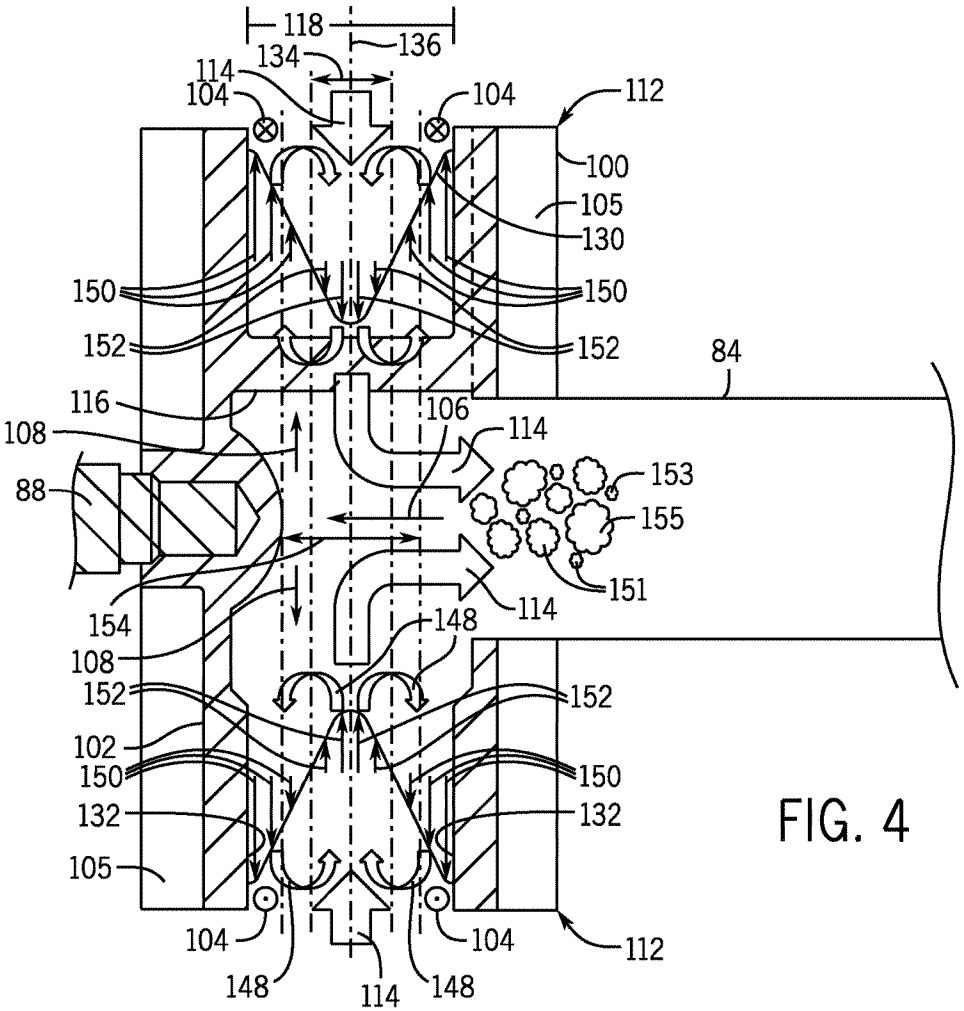
FIG. 4 is a cross-sectional view of an embodiment of the reverse-acting pump of FIG. 2, taken along line 3-3.

FIG. 4 illustrates a cross-sectional view of an embodiment of the reverse-acting pump 80 of FIG. 2, taken along line 3-3. The illustrated cross-sectional view in FIG. 4 depicts an embodiment of the reverse-acting pump 80 in operation when the discharge pressure generated by the rotation of the discs 100, 102 is less than the upstream pressure at the outlet 82. The shaft 88 drives the opposing discs 100, 102 in the clockwise tangential direction 104. Under some operating conditions, the fluid (e.g., slag slurry 14) between the discs 100, 102 of the reverse-acting pump 80 may flow in a dual recirculation pattern oriented in the radial direction, as shown by arrows 148. For example, the fluid may recirculate when the discharge pressure generated by the rotation of the discs 100, 102 is approximately equal to the upstream pressure at the outlet 82 (e.g., the difference between the upstream pressure and the discharge pressure is approximately zero), the outlet 82 is closed off and/or the inlet 84 is closed off, or any combination thereof. In the dual radial recirculation pattern of the fluid (e.g., slag slurry 14), the fluid near surfaces 132 of the discs 100, 102 flows radially outward toward the perimeter 112, and the fluid near the middle region 134 flows radially inward toward the longitudinal axis 106.

When the upstream pressure at the outlet 82 is greater than the discharge pressure generated by the rotation of the discs 100, 102, the net flow through the reverse-acting pump 80 is from the outlet 82 to the inlet 84, as shown by arrows 114.

The radial velocity profile 130 illustrated in FIG. 4 is based on the existence of a no-slip condition between the fluid (e.g., slag slurry) and the disc surfaces 132 when the discharge pressure generated by the rotation of the discs 100, 102 is less than the upstream pressure at the outlet 82. The interaction (e.g., friction, adhesion) between the fluid (e.g., slag slurry 14) and the disc surfaces 132 drives the fluid adjacent to the discs 100, 102 radially outward toward the perimeter 112, whereas the greater upstream pressure relative to the discharge pressure generated by the rotation of the discs 100, 102 drives the fluid near the middle region 134 radially inward toward the longitudinal axis 106. For example, velocity vectors 150 for the fluid near the discs 100, 102 illustrate the radially outward flow driven by the discs 100, 102, and the velocity vectors 152 for the fluid in the middle region 134 illustrate the radially inward flow driven by the pressure difference at the outlet 82. When the upstream pressure is greater than the discharge pressure generated by the rotation of the discs 100, 102, the fluid (e.g., slag slurry 14) within the middle region 134 flows downstream, as illustrated by arrows 114.

As may be appreciated, the radial velocity profile 130 (e.g., velocity vectors 150 and 152) may vary based at least in part on the rotational speed of the opposing discs 100, 102. The rotational speed of the discs 100, 102 affects the magnitude of the backflow 114 through the reverse-acting pump 80. Increasing the rotational speed of the discs 100, 102 may increase the magnitude of the velocity vectors 150, decrease the width of the middle region 134, and decrease the magnitude of the velocity vectors 152, thereby increasing the discharge pressure generated at the outlet 82. Likewise, decreasing the rotational speed of the discs 100, 102, may decrease the magnitude of the velocity vectors 150, increase the width of the middle region 134, and increase the magnitude of the velocity vectors 152, thereby decreasing the discharge pressure generated at the outlet 82. The rate of backflow 114 through the reverse-acting pump 80 is based at least in part on a difference between the upstream pressure at the outlet 82 and the discharge pressure generated by the reverse-acting pump 80. The rate of the backflow 114 through the reverse-acting pump 80 increases as the difference between the upstream pressure and the discharge pressure generated at the outlet 82 by the rotating discs 100, 102 increases. As may be appreciated, the relationship between the rate of the downstream flow 114 and the difference between the upstream pressure and the developed discharge pressure may be a proportional relationship, an exponential relationship, a logarithmic relationship, or any combination thereof. Accordingly, increasing the rotational speed of the discs 100, 102 may increase the discharge pressure generated at the outlet 82 and decrease the difference between the upstream pressure and the discharge pressure, thereby reducing the rate of backflow 114 through the reverse-acting pump 80. Likewise, decreasing the rotational speed of the discs 100, 102 may decrease the discharge pressure generated at the outlet 82 and increase the difference between the upstream pressure and the discharge pressure, thereby increasing the rate of backflow 114 through the reverse-acting pump 80.

Particles 151 (e.g., slag 58) within the fluid (e.g., slag slurry 14) may flow from the outlet 82 to the inlet 84 with the backflow 114. As may be appreciated, slag particles 151 of various sizes may encounter the recirculating flow pattern 148 between the discs 100, 102 as they move with the backflow 114 between the discs 100, 102. The majority of particles 151 may generally be confined to the middle region 134 between the discs 100, 102 where the radially inward velocities 152 and the positive pressure difference between the upstream pressure and the pressure generated by the rotating discs 100, 102 at the pump outlet 82 drives the particles 151 backwards through the reverse-acting pump 80 from outlet 82 to inlet 84. In some situations, some of the slag particles 151 may drift outwards, away from the centerline 136, and may encounter the region outside of the middle region 134 and may become entrained in that portion of the flow profile defined by the radially outward velocity vectors 150 near the surfaces 132 of the opposing discs 100, 102. In such situations, the particles 151 will move radially outwards from the inlet 82 to the outlet 84, thereby moving in the opposite direction from the net backwards flow 114 from the outlet 82 to the inlet 84 of the pump. Smaller particles 153 may be more likely than larger particles 155 to be entrained in this recirculating flow pattern 148. Nevertheless, because the upstream pressure is greater than the pressure generated at the pump outlet 82 and because there is a net backflow 114 of slag slurry 14 from pump the outlet 82 to the pump inlet 84, these smaller particles 153 are not likely to accumulate in the reverse-acting pump 80. That is, the net backflow 114 of the slag slurry 14 may eject the smaller particles 153 from the recirculation pattern 148 such that the smaller particles 153 exit the reverse-acting pump 80 via the pump inlet 84 as part of the backflow stream 114.

Relatively large particles 155 that enter the reverse-acting pump 80 through the outlet 82 may backflow through the reverse-acting pump 80 even if the respective particle diameter exceeds the width of the middle region 134 where the velocity vectors 152 point radially inward. Despite the fact that a portion of a large particle 155 may encounter the region near the disc surfaces 132 outside of the middle region 134, and may thereby encounter a portion of the velocity profile 130 in which the velocity vectors 150 point radially outward, the momentum of the backflow 114 stream is sufficient to direct the large particle 155 from the pump outlet 82 to the pump inlet 84. However, in some cases, the diameter of a large particle 155 may be large enough so that it encounters a substantial portion of the velocity profile 130 in which the velocity vectors 150 point radially outwards in addition to the central portion 134 of the flow profile 130 in which the velocity vectors 152 point radially inward. In such cases, the drag on the large particle 155 by the radially inward portion 152 of the flow profile 130 may approximately balance the drag on the large particle 155 by the radially outward portion 150 of the flow profile. In such cases, such large particles 155 may begin to accumulate within the reverse-acting pump 80. Thus, a central region 154 of the flow profile 130 may exist for which large particles 155 whose diameters fit within that central region 154 may backflow through the reverse-acting pump 80 (e.g., arrows 114), whereas large particles 155 with diameters greater than the width of the central region 154 may accumulate within the reverse-acting pump 80 until the rotational speed of the reverse-acting pump 80 increases, thereby widening the central region 154. Thus, the width of the central region 154 that includes some of the radially outward flow (e.g., radial velocity vectors 150) may determine the maximum particle size that may flow from the outlet 82 to the inlet 84 of the reverse-acting pump 80. In some embodiments, particles 155 (e.g., slag 58) wider than the central region 154 may not flow through the reverse-acting pump 80. The central region 154 is wider than the middle region 134.

The controller 18 may control the one or more slag crushers 64 to reduce the particle size, such that the slag slurry 14 may flow through the reverse-acting pump 80.

Additionally, or in the alternative, the controller 18 may longitudinally adjust the reverse-acting pump 80 along the longitudinal axis 106 to control the width of the central region 154. For example, the controller 18 may control the one or more spacers 116 to expand or contract to control the spacing 118 between the discs 100, 102. Through control of the spacing 118, the controller 18 may also control the widths of the middle portion 134 and the central region 154, thereby enabling the controller 18 to control the size of particles 151 that flow through the reverse-acting pump 80. As discussed above, the spacing 118 may affect the discharge pressure at the outlet 82. The difference between the discharge pressure and the upstream pressure may affect the central region 154. For example, a large pressure difference may cause the central region 154 to widen to accommodate a greater backflow rate of the fluid (e.g., slag slurry 14). In some embodiments, the controller 18 may control the spacing 118 and the speed of the reverse-acting pump 80 to control the discharge pressure and the width of the central region 154, thereby controlling the flow of the fluid (e.g., slag slurry 14) from the outlet 82 to the inlet 84 of the reverse-acting pump 80.

Figure 5:
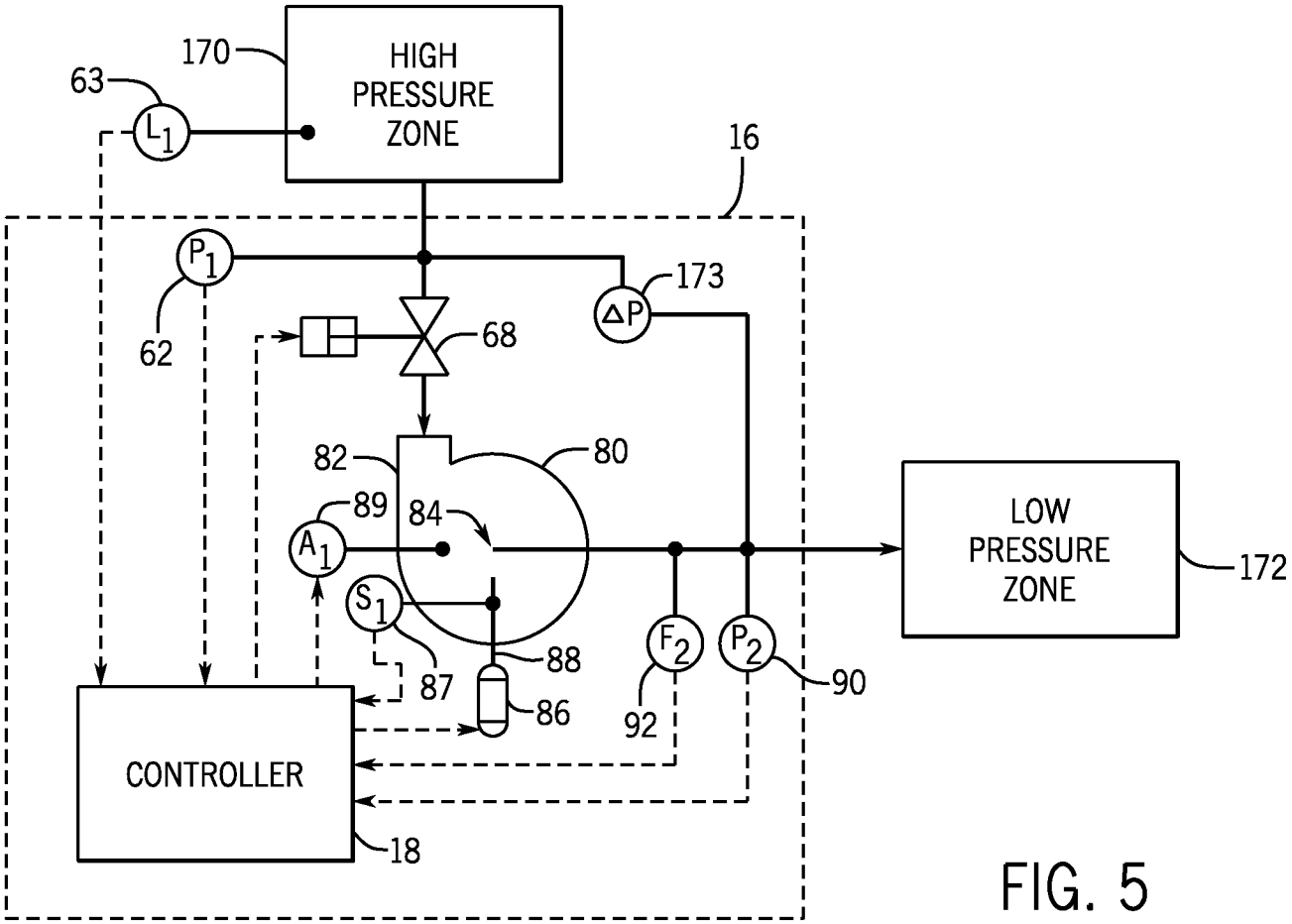
FIG. 5 is a schematic diagram of an embodiment of the depressurization system.

FIG. 5 is a schematic diagram of an embodiment of the depressurization system 16 arranged between a high pressure zone 170 (e.g., gasifier 12) and a low pressure zone 172 (e.g., downstream processing system 94). The high pressure zone 170 may include, but is not limited to a gasifier 12, a reactor, a tank, or any combination thereof. The low pressure zone 172 may include, but is not limited to, a downstream processing system 94, a reactor, a tank, or reservoir at low pressure relative to the high pressure zone 170 (e.g., atmospheric pressure, approximately 206 kPa gauge, 345 kPa gauge, or 483 kPa gauge (e.g., approximately 30 psig, 50 psig, or 70 psig) or more), or any combination thereof. As may be appreciated, the fluid may include, but is not limited to, the slag slurry 14, a carbonaceous slurry, a mineral slurry, or any combination thereof. The high pressure zone 170 supplies fluid (e.g., slag slurry 14) to the depressurization system at the upstream pressure, which may be sensed by the pressure sensor "P1" 62. The reverse-acting pump 80 depressurizes the fluid from the upstream pressure at the outlet 82 to a downstream pressure at the inlet 84. The pressure sensor "P2" 90 may sense the downstream pressure of the fluid from the inlet 84. Additionally, or in the alternative, a pressure differential sensor 173 with high leg at the location of pressure sensor "P1" 62 and low leg at the location of pressure sensor "P2" 90 may sense the pressure drop across the pump 80 directly. The speed of rotation of the reverse-acting pump 80 may be sensed by speed sensor "S1" 87 connected to the shaft 88 of the reverse-acting pump 80; and the speed of rotation of the reverse-acting pump 80 may be controlled by the controller 18 and the motor 86. The spacing between the discs 100, 102 may be controlled by controller 18 and disc spacing actuator "A1" 89. The pressure drop from the outlet 82 to the inlet 84 of the reverse-acting pump 80 may be based at least in part on the size of the reverse-acting pump 80, the speed of the reverse-acting pump 80, the spacing 118 between the discs 100, 102 of the reverse-acting pump 80, or the flow rate through the reverse-acting pump 80, or any combination thereof. In some embodiments, the pressure drop from the outlet 82 to the inlet 84 of the reverse-acting pump 80 may be less than approximately 5,000, 4,000, 3,000, 2,000, 1,000, 500, 200, 100, 50 kPa (e.g., less than approximately 725, 580, 435, 290, 145, 73, 29, 14.5, or 7.3 psi). The controller 18 may control the motor 86 and/or the disc spacing actuator "A1" 89 to adjust the pressure drop via control of the speed of the reverse-acting pump 80 and/or the spacing 118 between the discs 100, 102.

In some embodiments, the depressurization system 16 may have multiple reverse-acting pumps 80 coupled together in series to enable a desired pressure drop. For example, a first and a second reverse-acting pump 80 may each depressurize a fluid flow by up to approximately 5,000 kPa (e.g., approximately 725 psi). Coupling the inlet 84 of the first reverse-acting pump 80 to the outlet 82 of the second reverse-acting pump 80 in series may enable the depressurization system 16 with the first and the second reverse-acting pumps 80 to depressurize a fluid flow by up to approximately 10,000 kPa (e.g., approximately 1,450 psi). Embodiments with multiple reverse-acting pumps 80 may include one or more sensors (e.g., pressure sensors, flow sensors) between reverse-acting pumps 80 in addition to the sensors (e.g. pressure sensors, flow sensors) upstream of the first pump 80 and the sensors (e.g. pressure sensors, flow sensors) downstream of the last pump 80.

The depressurization system 16 continuously conveys fluid from the high pressure zone 170 to the low pressure zone 172. The flow sensor "F2" 92 may sense a flow rate from the reverse-acting pump 80 and provide feedback to the controller 18. Based at least in part on the feedback from the flow sensor "F2" 92, the controller 18 may control the motor 86 and/or the disc spacing actuator 89 as described above to maintain a flow rate of the fluid (e.g., slag slurry 14) within a desired threshold range. Moreover, the controller 18 may monitor feedback from the flow sensor "F2" 92 to identify any discrepancies between a desired output from the depressurization system 16 as controlled by the controller 18, and the sensed output from the depressurization system 16. For example, the controller 18 may identify blockages or accumulation of particles in the reverse-acting pump 80 from a decreasing flow rate of the fluid. Additionally, or in the alternative, the controller 18 may identify an unexpected stoppage of the reverse-acting pump 80 due to a change (e.g., increase) in the sensed flow rate and/or the sensed pressure and/or the sensed shaft speed. For example, the controller 18 may identify a rapid depressurization of the fluid from the high pressure zone 170 from a sudden increase in the sensed pressure at the pressure sensor "P2" 90 and/or a sudden increase in the sensed flow rate at the flow sensor "F2" 92. In the event of a decreasing flow rate, the controller 18 may respond by reducing the speed of the motor 86 in order to decrease the speed of the reverse-acting pump 80 and/or by controlling the disc spacing actuator "A1" 89 in order to increase the spacing between discs. The controller may close the isolation valve 68 to allow for maintenance of the reverse-acting pump 80 and/or to stop depressurization in the event of a sudden stoppage of the reverse-acting pump 80 and a rapid depressurization of the fluid.

The depressurization system 16 may aid maintenance of a steady fluid level in the high pressure zone 170 (e.g., in the quench sump 48 of the gasifier quench chamber 22, as shown in FIG. 1), such as by continuously conveying a steady flow rate of fluid from high pressure zone 170 to low pressure zone 172. In some embodiments, the controller 18 may identify a blockage in the quench liquid blowdown line 49 in FIG. 1 from an increasing level in the quench sump 48 (i.e. the high pressure zone 170) sensed by level sensor 63 "L1" in FIG. 5. The controller 18 may respond to a sensed increase in quench sump level by increasing the flow of fluid through the reverse-acting pump 80 in order to compensate for the fluid which is not being removed through the quench liquid blowdown line 49 in FIG. 1. The controller 18 may decrease the speed of the motor 86 in order to increase the flow through the reverse-acting pump 80 and/or may adjust the disc spacing actuator "A1" 89 in order to increase the spacing between discs 100, 102, thereby increasing the flow through the reverse-acting pump 80.

Additionally, or in the alternative, the depressurization system 16 may aid maintenance of a steady pressure (e.g., P2) at the pump inlet 84 and/or the inlet to the low pressure zone 172 (e.g., downstream slag processing system 94). The controller 18 may control the speed of the motor 86 and/or the spacing between the discs 100, 102 to control the pressure sensed by the second pressure sensor 90 and/or the differential pressure sensor 173. In some embodiments, the low pressure zone 172 may have a threshold pressure such that fluids (e.g., slag slurry 14) received at pressures greater than or approximately equal to the threshold pressure may flow through the low pressure zone 172 (e.g., downstream slag processing system 94). As may be appreciated, the controller 18 may control the pressure of the fluid received by the low pressure zone 172 to one or more desired pressures during startup, steady state operation, or during shutdown of the system 9. The one or more desired pressures may be predefined or received by the system 9, and may be based at least in part on the components of the low pressure zone 172.

Technical effects of the invention include enabling a reverse-acting pump to continuously depressurize a fluid. The reverse-acting pump receives the fluid (e.g., slag slurry) through the outlet at an upstream pressure from a high pressure zone, and discharges the fluid to a low pressure zone through the inlet at a downstream pressure less than the upstream pressure. The reverse-acting pump drives a portion of the fluid from the inlet to the outlet at a discharge pressure that is characteristic of the pump geometry and the speed of rotation of the discs, thereby generating an adjustable resistance to the flow of the fluid from the high pressure zone. The portion of the fluid driven to the outlet at the discharge pressure recirculates from the outlet back through the reverse-acting pump when the discharge pressure generated by the pump is less than or equal to the upstream pressure. The discharge pressure of the reverse-acting pump is controlled by varying the speed of rotation of the discs or by varying the spacing between discs in order to adjust the flow rate of the fluid from the outlet to the inlet. Increasing the speed of the reverse-acting pump increases the discharge pressure generated by the pump, and decreasing the speed of the reverse-acting pump decreases the discharge pressure generated by the pump. Additionally, the spacing between discs of the reverse-acting pump may be controlled to adjust both the flow rate of fluid as well as the maximum particle size that may flow through the reverse-acting pump from the outlet to the inlet.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system comprising:

a first pump comprising a first outlet and a first inlet, wherein the first pump is configured to continuously receive a flow of a slurry into the first outlet at a first pressure and to continuously discharge the flow of the slurry from the first inlet at a second pressure less than the first pressure; and a controller configured to control a first speed of the first pump against the flow of the slurry based at least in part on the first pressure, wherein the first speed of the first pump is configured to resist a backflow of slurry through the first pump from the first outlet to the first inlet.

2. The system of claim 1, wherein the first pump comprises a pair of opposing discs coupled to a shaft and configured to rotate in a first direction against the flow of the slurry, the first outlet is tangentially aligned opposite to the first direction, the first inlet is axially aligned with the shaft, the pair of opposing discs is configured to drive a portion of the slurry in a first radial direction from the shaft towards the first outlet, and the portion of the slurry is configured to recirculate in a second radial direction opposite to the first radial direction towards the first inlet based at least in part on a differential pressure between the first pressure and the second pressure.

3. The system of claim 2, wherein the controller is configured to adjust a distance between the pair of opposing discs based at least in part on a particle size of the slurry.

4. The system of claim 1, wherein the controller is configured to increase the first speed of the first pump to increase a differential pressure between the first pressure and the second pressure, the controller is configured to decrease the first speed of the first pump to decrease the differential pressure, and the flow of the slurry through the first pump is based at least in part on the differential pressure.

5. The system of claim 4, wherein the controller is configured to control the first speed of the first pump to control the differential pressure to be between 500 to 5,000 kPa.

6. The system of claim 1, comprising one or more sensors configured to sense at least one of the first pressure and the second pressure.

7. The system of claim 1, comprising an isolation valve coupled to the outlet, wherein the controller is configured to close the valve in response to a depressurization condition of the slurry through the first pump.

8. The system of claim 1, comprising a flow sensor coupled to the controller and to the inlet, wherein the controller is configured to control the first speed of the first pump to control the flow of the slurry through the first pump based at least in part on feedback from the flow sensor.

9. The system of claim 1, comprising:

a second pump coupled in series with the first pump, wherein the second pump comprises a second outlet and a second inlet, wherein the second outlet is configured to continuously receive the flow of the slurry from the first inlet at the second pressure, the second inlet is configured to continuously discharge the flow of the slurry at a third pressure less than the second pressure, and the controller is configured to control a second speed of the second pump against the flow of the slurry based at least in part on the first pressure.

10. A system comprising:

a reverse-acting pump comprising an outlet and an inlet, wherein the outlet is configured to continuously receive a flow of a slurry at a first pressure and the inlet is configured to continuously discharge the flow of the slurry at a second pressure less than the first pressure;

an isolation valve coupled to the outlet of the reverse-acting pump; and a controller coupled to the reverse-acting pump and the isolation valve, wherein the controller is configured to control the flow of the slurry through the reverse-acting pump via control of a speed of the reverse-acting pump, to close the isolation valve in response to a sudden stoppage of the reverse-acting pump, or any combination thereof.

11. The system of claim 10, wherein the reverse-acting pump comprises a variable-speed reverse-acting pump, and the controller is configured to control the speed of the variable-speed reverse-acting pump based at least in part on the first pressure.

12. The system of claim 10, comprising a gasifier configured to supply the flow of the slurry to the isolation valve, wherein the slurry comprises a slag slurry.

13. The system of claim 10, comprising a pressure sensor coupled to the controller, wherein the pressure sensor is configured to sense the second pressure, and the controller is configured to control the speed of the reverse-acting pump to maintain the second pressure between 690 kPa and atmospheric pressure.

14. The system of claim 13, wherein the first pressure is between 100 and 10,000 kPa, and the second pressure is based at least in part on a downstream slag processing system configured to receive the slurry.

15. The system of claim 10, comprising a pressure sensor coupled to the controller, wherein the pressure sensor is configured to sense the first pressure, and the controller is configured to control the flow of the slurry based at least in part on the first pressure.

16. A method comprising:

receiving a flow of a slurry at a first pressure through an outlet of a pump;

driving the pump at a speed configured to resist a back-flow of the slurry from the outlet to an inlet;

controlling the speed of the pump;

discharging the flow of the slurry at a second pressure less than the first pressure from an inlet of the pump; and controlling a rate of the flow of the slurry through the pump via controlling the speed of the pump.

17. The method of claim 16, wherein increasing the speed of the pump decreases the rate of the flow of the slurry, and decreasing the speed of the pump increases the rate of the flow of the slurry.

18. The method of claim 16, comprising sensing the first pressure of the flow of the slurry and controlling the rate of the flow through the pump based at least in part on the first pressure.

19. The method of claim 16, comprising closing an isolation valve coupled to the outlet based at least in part on a rapid depressurization condition of the slurry through the pump.

20. The method of claim 16, comprising controlling a distance between a pair of opposing discs of the pump based at least in part on a particle size of the slurry.

* * * * *